United States Patent [19]

Paton et al.

[11] 4,018,383

[45] Apr. 19, 1977

[54] PROCESS FOR PRODUCTION OF DROP STREAMS

[75] Inventors: Anthony David Paton, Chesterton Hall Cresent; Roger John Rowland, Longstanton, both of England

[73] Assignee: Imperial Chemical Industries Limited, London, England

[22] Filed: June 2, 1975

[21] Appl. No.: 582,881

[30] Foreign Application Priority Data

June 5, 1974 United Kingdom ..... 24889/74

[52] U.S. Cl. ..... 239/4; 346/75

[51] Int. Cl.[2] ..... B05B 17/06

[58] Field of Search ..... 239/4, 101, 102; 346/75, 140

[56] References Cited

UNITED STATES PATENTS

| | | | |
|---|---|---|---|
| 3,334,351 | 8/1967 | Stauffer | 346/75 |
| 3,739,393 | 6/1973 | Lyon et al. | 239/102 X |
| 3,823,408 | 7/1974 | Gordon | 239/601 |
| 3,893,131 | 7/1975 | Perel | 346/75 |
| 3,928,855 | 12/1975 | Helinski et al. | 346/75 X |

*Primary Examiner*—John J. Love

*Attorney, Agent, or Firm*—Cushman, Darby & Cushman

[57] ABSTRACT

Process for the production of drop streams by modulating a liquid jet issuing from a nozzle, characterized in that the jet modulation comprises a wave having the fundamental frequency of drop formation, together with a second wave whose frequency is twice that of the fundamental wave.

This simultaneous use of the two waves controls the shape of the devices for the production of such drop streams, and the use of such drop streams in droplet printing, in crop spraying and the production of spray dried products.

2 Claims, 3 Drawing Figures

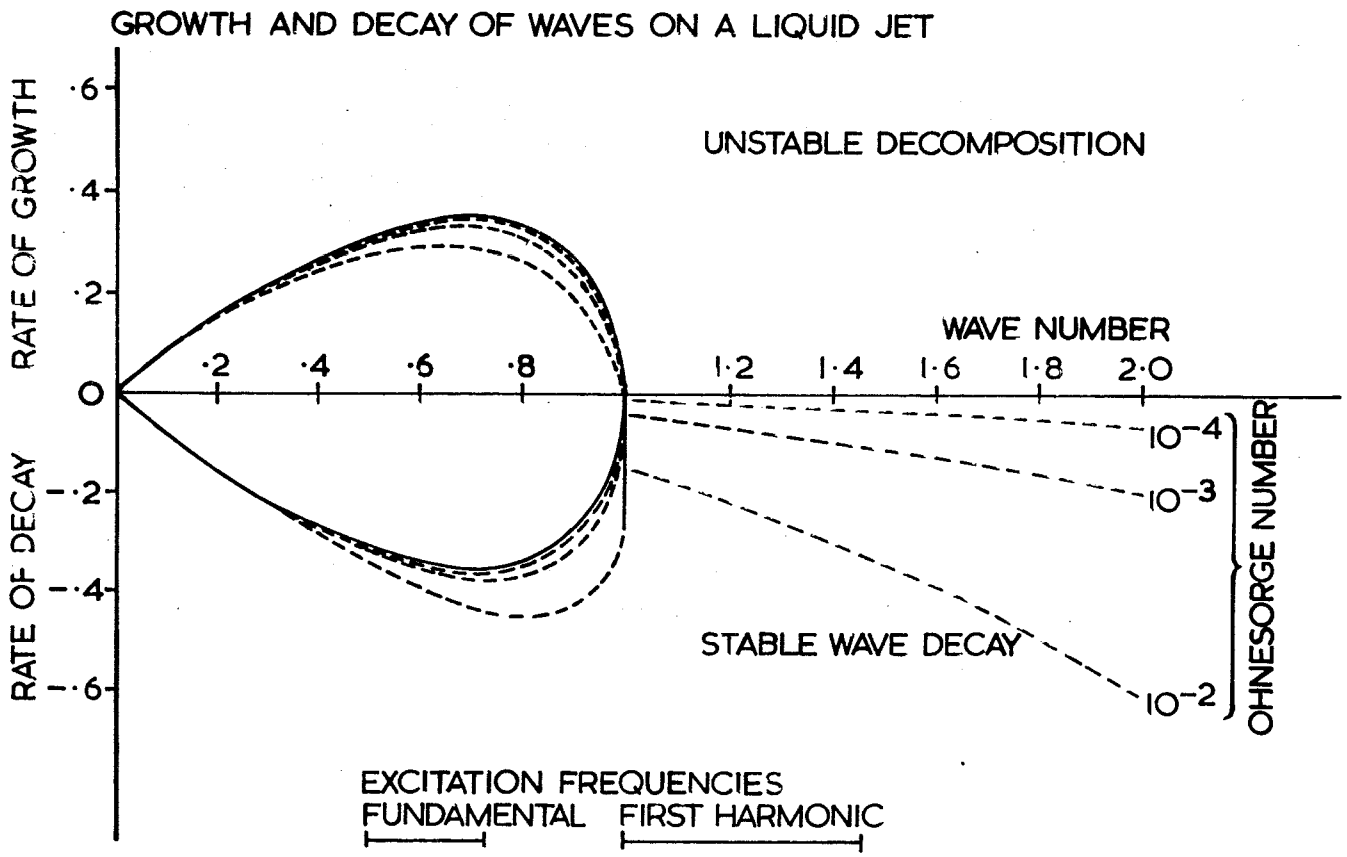
FIGURE I

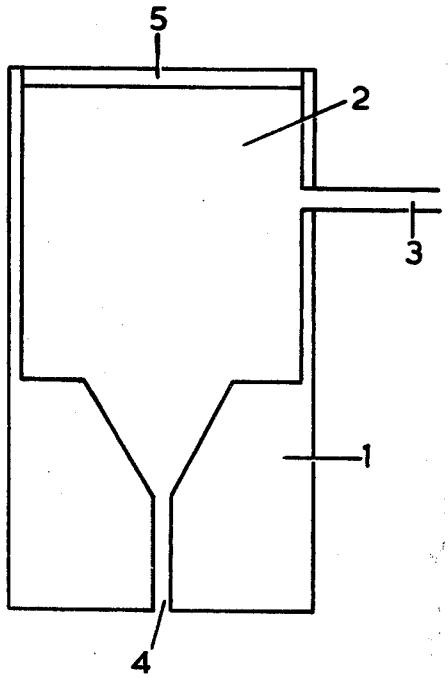
FIG II

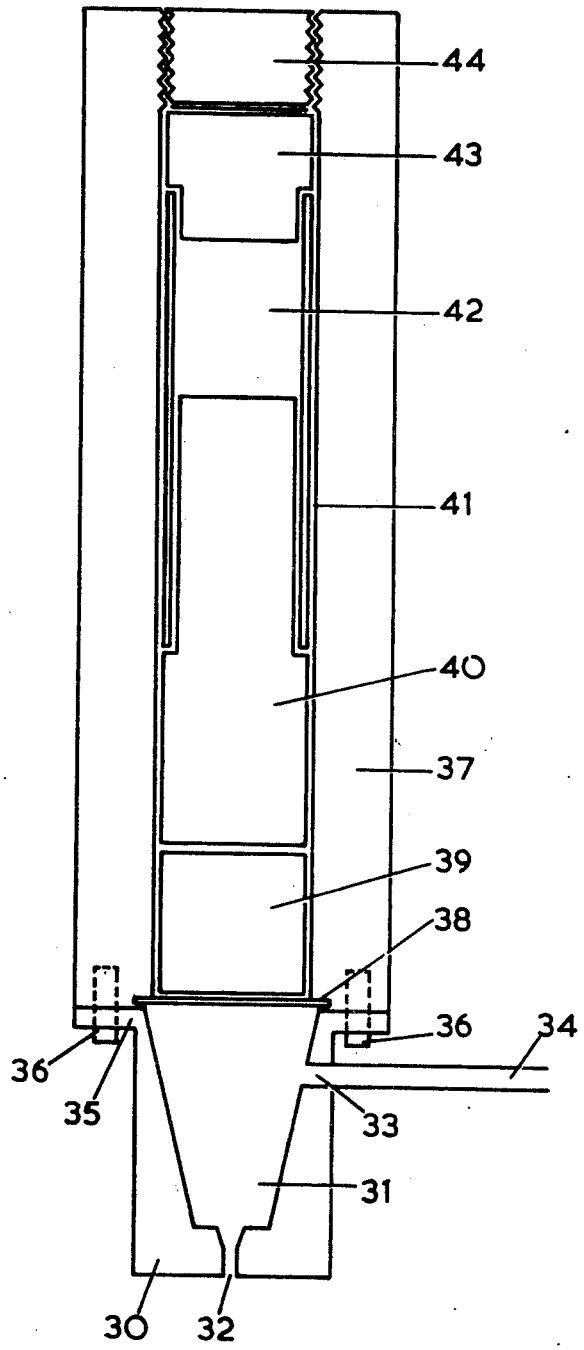
FIG III

PROCESS FOR PRODUCTION OF DROP STREAMS

This invention relates to an improved process for the production of drop streams.

It is well known to produce drop streams, wherein the drops are substantially of identical size, by modulation of jets of liquid. In this method a liquid under pressure is passed through a nozzle and modulations are applied to the jet of liquid issuing from the nozzle, to form varicosities or modulations in the cross section of the jet of liquid. The methods of modulation which can be applied include the mechanical vibration of the nozzle and the generation of variations in the fluid pressure in the manifold of which the nozzle is a component part, by means for example of an electrically energised piezoelectric crystal or magnetostrictive device or other acoustic wave generator. The resulting modulations of the surface of the jet of liquid are amplified by the action of the surface tension of the jet of liquid together with the other fluid properties, and result in the case of a periodic modulation in the break-up of the jet of liquid into a coherent stream of drops.

However it has often been observed that as a jet of liquid breaks up to form a regular drop stream, there is also produced from the ligaments which remain in between each drop at the point of drop formation, a stream of satellite drops. As the jet of liquid necks to form each ligament at the break-up point, fluid velocity motions are generated along the axis of the jet of liquid away from the neck. These in turn generate points of lower pressure on either side than the pressure obtaining at the neck, and result in turn in the formation of secondary drops which are referred to as satellites. The resulting drop stream will therefore comprise two drop streams of two different sizes or a single drop stream containing two different sizes of drops.

In many industrial applications involving the production of coherent or monodisperse drop streams the performance of the process is severely impaired by the presence of the satellite drops. Thus, for example, in one such application the liquid consists of a slurry, which when formed into drops is to be dried to form a powdered product, typically a powdered food product or fertilizer. If the drops are of different sizes, it happens either that the smaller drops are overheated and burnt, or that the larger drops are incompletely dried. The resulting quality of the dried product is accordingly inferior to that which can be obtained when all the drops are of an equal or nearly equal size. In a second application involving crop spraying it is desirable also to form drops of equal sizes to maintain a constant distribution of the spray material.

In a third application of electrostatic drop printing it is known that the formation of satellite drops forms uncertainties in the charge formation in the drop stream with consequent irregularities in the resulting printing and a collection of mist on the operating surfaces, which are deleterious to reliable operation.

It has been found that the formation of satellite drops can be minimised or even eliminated by forming on the surface of the liquid jet modulations whose waveshape includes the fundamental frequency of drop formation together with a second frequency which is twice that of the fundamental.

Accordingly the present invention is directed to an improved process for the production of drop streams by modulating a liquid jet issuing from a nozzle, characterised in that the jet modulation comprises a wave having the fundamental frequency of drop formation, together with a second wave whose frequency is twice that of the fundamental wave.

This simultaneous use of the two waves controls the shape of the ligament which forms between adjacent drops, thereby controlling the formation of extinction of the satellite drop.

Preferably the relative phases of the fundamental and second modulations are selected to favour the extinction of the leading or lagging tendril of the said ligament.

In order that the invention can be successfully applied it is necessary to describe its operation by reference to the break-up process into a stream of drops of a liquid jet issuing from a nozzle.

It is known that a liquid jet of a selected diameter and velocity breaks up in response to regularly spaced varicosities, or modulations formed in its surface, when the modulation frequency is lower than the cut-off frequency of the liquid jet. This limit corresponds to the condition when the wavelength of the modulation on the jet, which is the jet velocity divided by the modulation frequency, equal the circumference of the jet. Waves shorter than the jet circumference are stable and decay under the action of viscous damping. Waves longer than the circumference are unstable and increase in amplitude to result in the break up of the jet into drops formed at the modulation frequency.

It is also known that when the liquid jet of the selected diameter and velocity breaks up, the surface waves on the jet grow exponentially in time. The characteristic growth rates for a jet, derived analytically are shown in FIG. 1., of the accompanying drawings, and illustrate how the exponent varies with the wavenumber of the jet (which is the circumference of the jet divided by the wavelength of modulation). The exponent is plotted for several values of:

$$\theta = \mu^2/(\alpha\rho R) = \text{(Ohnesorge Number of the jet)}$$

$$= 2\ [\text{(Weber Number)}/\text{(Reynolds Number)}^2]$$

where $\mu$=viscosity of the printing liquid $\alpha$=surface tension of the liquid $\rho$=density of the liquid R=radius of the jet For a jet of low viscosity waves grow most rapidly at a wavenumber of 0.697 but there is a tendency for the optimum wavenumber and corresponding optimum frequency to be reduced for higher levels of viscosity in the liquid. In the example, therefore, where a modulation frequency of F Hz is applied to the jet whose diameter and velocity have been selected for break up at the maximum exponential growth rate, the cut off frequency is 1.43F Hz for a low viscosity jet.

It is further known that as the surface waves amplify on the jet to form separate drops, there is a tendency for the ligaments of liquid which remain between each drop pair immediately before break up to form a smaller interspersed stream of satellite drops. Under certain conditions however it has been found possible to mix, with the modulation of frequency F Hz, a further double frequency modulation 2F Hz which has the effect of influencing the shape of the ligament and which controls satellite formation. These controlling conditions are specified levels of amplitude and phase of the controlling modulation. Additionally they depend on the wavenumber which characterises the fundamental modulation applied to the jet together with the jet viscosity. The conditions also depend on whether the first frequency of modulation is greater or less than half the cut-off frequency of the jet.

In the example of a jet of low viscosity, therefore, where the first modulation frequency is FHz and is at the most unstable position, so that the cut-off frequency is in the region 1.43F Hz, it can be seen that the second modulation frequency 2F Hz is in the stable region. The wave produced by the first modulation therefore grows on the surface of the jet due to the combined actions of surface tension and density, modified by the viscosity of the liquid while the wave produced by the second modulation is damped by the viscosity of the liquid. Under this condition in order to ensure that there remains an adequate amplitude of the waves of the second (double frequency) modulation to influence the shape of the ligament at break-up and thereby to control satellite formation, it is necessary to ensure that sufficient (i.e. over 1%) of that wave remains.

To ensure this, under the condition where the first modulation has an amplitude ($A_1$) and a frequency near the optimum growth rate, and the second modulation has an amplitude ($A_2$) at twice the said frequency, and where R is the radius of the jet, it is stipulated that $$A_2(A_1/R)^S > 0.01R$$

wherein $S = 2k^2\sqrt{9\theta/2}\,.\,(1+\sqrt{9\theta/2})$ $k$ = wavenumber corresponding to the fundamental frequency of drop formation $\theta$ = Ohnesorge number, as defined above.

Consideration of the above condition shows that the invention may be practiced successfully to control satellites in the case of jets of low viscosity near the optimum frequency, when the first modulation ($A_1$,F) is of a great enough magnitude, so that the second modulation ($A_2$2F) has not been damped out by the liquid viscosity during the break up time of the jet.

A wider understanding of the invention may be obtained by reference to FIG. I in operating conditions which differ from those in the example above. In a further example, therefore, of a jet of a liquid of increased viscosity, the characteristics of the break up process of the jets are altered, such that the optimum wavenumber and the corresponding exponent of the optimum break up are reduced. At the same time the rate of damping of waves at a wavenumber above unity is increased.

In this example of a jet of higher viscosity, therefore when a first modulation frequency F Hz is applied to the jet at the most unstable frequency, so that the cut-off frequency is in the region between 1.43F Hz and 2F Hz and when a second modulation frequency 2F Hz is also applied to the jet the condition above:

$$A_2\,(A_1/R)^S > 0.01R$$

must again be satisfied to ensure that sufficient (i.e. over 1%) of the second (double frequency) modulation remains on the jet at break up to influence the shape of the ligament and thereby to control satellite formation. It will be observed that higher amplitudes $A_1$ and $A_2$ will be required to meet this condition as the viscosity parameter of the jet increases.

In a further example, when the first modulation frequency F Hz is at a frequency above the optimum frequency of break up for the jet the fundamental exponent of modulation is lower, so that the growth rate of drops from the jet is reduced, but that the second frequency modulation $A_1$ and $A_2$ are also required to satisfy the control requirements in this region. Conversely in the range when the first modulation frequency is below the optimum break up frequency, the fundamental modulations again tend to grow more slowly, but the second frequency modulation is less damped. As a result the amplitude levels for control are rather lower than the first example.

In a further example of the operating conditions of the invention at a frequency which is below half the cut-off frequency, it will be observed that the second modulation frequency 2F Hz moves into the region of the jet characteristic where it is also unstable.

Consequently both the fundamental modulation of frequency F Hz and the double frequency modulation 2F Hz are amplified on the jet. Hence the condition for satellite control on the jet, which is that the controlling double frequency modulation should be present at break-up to a sufficient degree (i.e. over 1%) has to be joined by a second condition, that the amplitude of the double frequency is not so great that it results in the formation of a drop stream containing twice the number of drops in preference to controlling break-up by the fundamental frequency.

In the case of the inviscid jet, these conditions are satisfied when:

$$.01\,R < A_2\left(\frac{A_1}{R}\right)^2 << R$$

where $S = \dfrac{4(1-4k^2)}{\sqrt{(1-k^2)}}$ and $k < ½$.

The corresponding condition in a jet which is formed of a viscous liquid requires S to be a function of $\theta$ in the form:

$$S = \sqrt{\frac{4(1-4k^2)}{(1-k^2)}}\;\frac{\exp\left(-\sinh^{-1}\left(\frac{9\theta}{2}\cdot\frac{4k^2}{1-4k^2}\right)^{1/2}\right)}{\exp\left(-\sinh^{-1}\left(\frac{9\theta}{2}\cdot\frac{k^2}{1-k^2}\right)^{1/2}\right)}$$

It is evident from FIG. 1, that when the fundamental frequency falls below a value of approximately 0.4 of the cut-off frequency, the double frequency modulation is of greater instability than the fundamental and only a small proportion of that modulation is needed to satisfy the amplitude conditions of the invention.

Tests have been made which illustrate the application of the invention, in which a jet of diameter 0.0075 cms was subjected to the combined modulations of a frequency 64 kHz and a frequency 128 kHz. The velocity of the jet was made to correspond to the wavenumber at which the waves of the fundamental frequency are most unstable, i.e. the velocity is about 2200 cms/second. For convenience the amplitudes of the fundamental and double frequency modulations were made equal, so that $(A_1/R) = (A_2/R)$. Tests were made with aqueous liquids of various viscosities in the jet and in each case the minimum modulation amplitude and break-up length was determined at which the influence of the double frequency could be observed to control the shape of the ligament between each drop pair immediately before the point of break up. The results were as follows:

| Viscosity of the liquid | Modulation amplitudes | Break up length of jet |
|---|---|---|
| 1 centipoise | .02 | 6.8 mms |
| 4 centipoises | .074 | 5.1 mms |
| 7 centipoises | .150 | 4.0 mms |

provide a clear insight into the working of the invention.

When the amplitude conditions of the invention are satisfied, so that a sufficient proportion of a double frequency wave persists on the jet at the point of break-up, it has also been found possible to alter or control the shape of the ligament by modifying the relative phase of the first and second modulations. It is possible to favour the extinction of the upper or lower tendril of the ligament by alteration of the relative phase of the harmonics, and thereby to favour the formation either of leading or lagging satellites. With the amplitudes of modulation stipulated above, the satellite drop can be eliminated entirely by merging it into the leading or lagging drop.

By these means it has been possible to produce drop streams wherein the simultaneous formation of satellite streams is minimised or even eliminated.

The natural tendency of a liquid jet to break-up into drops is known to be due to the action of surface tension of the liquid which combines with the other fluid properties to amplify varicosities or modulation induced in the cross section of the jet. Such modulations in the surface of the jet can be stimulated or induced while the jet emerges from a nozzle under static pressure by several physically distinct methods. For example it is known to modulate the nozzle mechanically so that the nozzle motion couples with the fluid velocity of the emerging jet. It is also known to generate pressure variations in the fluid manifold, for example by modulating the walls of the said manifold by piezoelectric or magnetostrictive or other acoustic means, thereby to induce variations in the jet velocity at the modulation frequency. It is also known to modulate the jet by passing the jet through a hole in a thin plate and applying an alternating voltage at the modulation frequency to the plate, thereby inducing a ring of charge on the jet, which stimulates the growth of surface modulation on the jet surface.

While the present inventon is principally described with reference to modulaton in the radius of the liquid jet, it will be appreciated that these modulations may be first generated or induced by any one of the previous methods of stimulation. It will also be appreciated that the conditions for satellite control above, which specify relative amplitudes of the two harmonics of modulation, can also be related to the agent of stimulus in these methods, provided the transmission characteristic of both the harmonics is quantitatively defined.

By way of example the perturbation of the velocity of the liquid in the jet may be stimulated by the action of a signal waveform including two periodic signals applied across a piexoelectric crystal which forms or is attached to one wall of a chamber containing the liquid which chamber is additionally fitted with a nozzle from which the liquid emerges in the form of a jet. The first signal generates the wave of the fundamental frequency of drop formation, and the second signal generates a wave of twice the frequency to control the form of the ligament at break-up. It will also be realised that the modulation waveform can also include higher harmonic frequencies, and may take the form of a set of square waves, or pulses, or saw tooth functions, which contain the said first and second harmonics.

Under certain conditions it can happen that pressure modulation applied to the nozzle from which issues the liquid jet, even when that pressure contains only the fundamental wave, results in wave amplitudes on the jet which include both the fundamental and higher harmonics. This is a result of the non-linear characteristics of the Navier-Stokes equation of fluid flow. It is evident that such inherent harmonics do not impede but assist with the method of satellite control, and may under certain conditions form a sufficient method of generation of those harmonics on the jet without their provision from an active source.

The process of the invention is of particular value in the production of granular products, such as coffee, dried milk and fertilisers, wherein a liquid slurry of the product is to be converted into a drop stream or streams which is then dried in hot air. The process of the invention is also of value in crop spraying which requires a uniform coverage of the crops, by for example a nutrient, insecticide or fungicide. Such coverage is not achieved when the drop stream contains satellite drops.

The process of the invention is also of value in 'drop printer' applications, in which a jet of liquid, in particular a printing liquid, is converted into a stream of drops, the individual drops are charged by passage through a charge electrode and are then deflected (according to the charge on the drop) by passage between deflector plates whereby the drops either alight in specific positions on a surface being printed or are collected in a gutter. The presence of satellites in the drop stream can result in an inaccurate rendering of the record or pattern on the surface to be printed and can also collect in parts of the printer where their presence is undesirable. These satellites can be minimised or even eliminated by using the process of the present invention for the production of the stream of drops of printing liquid. Drop printers to which the process of the present invention can be applied are described in, for example, British patent specifications Nos. 1,042,307, 1,042,685, 1,124,163, 1,354,890 and Belgian Patent specification No. 801,757.

The drop streams can be produced, for example, by passing a liquid under pressure along a tube which terminates in a nozzle, the tube or nozzle being surrounded by a magnetostrictive device or a piezoelectric crystal to which the two high frequency alternating currents are applied. Alternatively the nozzle can be attached to a chamber to which the liquid is supplied under pressure, and one wall of the chamber, or a part of such wall, consists of a magnetostrictive device or a piezoelectric crystal to which the two high frequency alternating signals are applied. As a variation of this last device one wall of the chamber, or a part thereof, can consist of an impervious membrane to which the magnetostrictive device or piezoelectric crystal is attached on the external face thereof. The two high frequency alternating signals which are applied to such devices or crystals differ by a factor of 2 in respect of their kHz values.

The process of the invention is preferably carried out by passing a pressurised liquid through a nozzle, modulation of the liquid stream which issues from the nozzle being achieved by the use of a piezoelectric crystal to which is applied a combined signal comprising the high frequency alternating signal of the fundamental frequency which causes drop formation together with a second high frequency alternating signal whose frequency is twice that of the fundamental signal. Thus, for example, when the frequency of the fundamental signal is 64 kHz so that drops are produced at the rate of 64000 per second, the frequency of the second signal will be 128 kHz.

By way of illustration a suitable device for producing the drop stream will not be described with reference to FIG. II of the accompanying drawings which represents a vertical cross-section of the device.

FIG. I shows the characteristic growth rates for a jet, and

FIG. III shows a pressure-loaded piezoelectric crystal.

The device comprises a housing 1 the upper part of which forms a chamber 2 which is connected to a source (not shown) of liquid under pressure via a tube 3. The lower part of the chamber 2 terminates in a nozzle 4 which communicates with the exterior of the housing 1. The top surface of the chamber 2 comprises a piezoelectric crystal 5, the gaps between the edges of the crystal and the housing being sealed by means of an adhesive so as to prevent loss of liquid from the chamber other than through the nozzle. The piezoelectric crystal is connected to a source of a combined signal as detailed above. Instead of the piezoelectric crystal 5 being in direct contact with the liquid in the chamber 2, the top of the chamber can be sealed with an impervious flexible diaphragm, to the outer surface of which is attached the piezoelectric crystal.

In operation liquid under pressure entering the chamber 2 via the tube 3 emerges from the nozzle 4 in the form of a jet of liquid which under the modulations applied to the liquid by the piezoelectric crystal breaks up into a stream of uniform sized drops.

In order to assist in promoting the break-up of the jet of liquid into drops it is preferred that the piezoelectric crystal is in the form of a resonant component which is in contact with the liquid or an impervious membrane which is itself in contact with the liquid, and such an arrangement forms a further feature of the present invention.

Such a resonant component can be conveniently obtained by extending the piezoelectric crystal with a load rod, which is preferably of metal, so that the combined structure is a resonant length at the modulation frequency. However in order to achieve the maximum effect it is necessary that the following relationship between the load rod and the piezoelectric crystal be satisfied.

$$\frac{P_2A_2V_2}{P_1A_1V_1} = \tan\frac{2\pi}{\lambda 1}\left(L_1 - \frac{\lambda_1}{4}\right) \times \tan\frac{2\pi}{\lambda 2} L_2$$

wherein $P_1$ is the density of the material used for the weight
$P_2$ is the density of the piezoelectric crystal
$A_1$ is the cross-section area of the load rod
$A_2$ is the cross-section area of the piezoelectric crystal
$V_1$ is the velocity of sound in the load rod
$V_2$ is the velocity of sound in the piezoelectric crystal
$L_1$ is the height of the load rod
$L_2$ is the height of the piezoelectric crystal
$\lambda_1$ is the wavelength of sound in the material used for the load rod
$\lambda_2$ is the wavelength of sound in the piezoelectric crystal The resonant component is mounted so that its resonant axis lies along the direction of formation of the liquid jet, and so that it is in good acoustic contact with the liquid or the impervius membrane. Such contact can be assisted by pressure on the resonant component, obtained for example by means of a spring or resilient plug.

By way of illustration a device which incorporates a pressure loaded piezoelectric crystal will now be described with reference to FIG. III of the accompanying drawings which represents a vertical cross-section of the device.

The device comprises a housing 30 which contains a recess 31 which terminates at its lower end in a nozzle 32. A passage 33 connects the recess 31 to a source (not shown) of liquid under pressure via a tube 34. The upper portion of the housing 30 comprises a flange 35. By means of bolts 36 passing through the flange 35 the housing is connected to an insulated block 37 which contains a cylindrical hole 42, the cylindrical hole 42 being directly above the recess 31. Situated within this cylindrical hole is an impervious membrane 38 which is sealed to the top of the housing 30 thus closing the top of the recess 31. Situated within the cylindrical hole 42 above the impervious membrane 38 are a piezoelectric crystal 39 and a metal rod 40 which is in direct contact with the piezoelectric crystal. The upper portion of the metal rod 40 is of smaller cross section than the lower portion so enabling a metal tube 41 to fit between the cylindrical hole 42 and the upper portion of the metal rod 40 and rest on the shoulder formed by the differing diameters of the upper and lower portions of the rod. The position of this shoulder is such that the resonating velocity of the system (i.e. the combined piezoelectric crystal and metal rod) at this point is zero or substantially zero. An insulated plug 43 sits on top of the metal tube 41, so that there is an air space between the bottom of the plug and the top of the metal rod 40, and the plug is firmly held in place by a screw 44 which engages in a threaded hole in the top of the insulated block 37. A cable (not shown) passes through the insulated block 37 and is connected to the metal rod 40 or the metal tube 41 thus enabling a combined signal as detailed above to be applied to the piezoelectric crystal 39 for the purpose of energising the piezoelectric crystal at the frequency of drop formation.

The recess 31 acts as a reservoir for the liquid which issues as a jet from the nozzle 32. Although the recess 31 is shown as being coned shaped it can be other shapes, for example cyclindrical or horn shaped.

The insulated block 37 is preferably constructed of a plastic material such as "Perspex" (a Registered Trade Mark). Although FIG. III only depicts one device, a row of such devices is in fact necessary when a number of drop streams are required. Such rows can readily be obtained by using a common block for all the devices in the row, each of the housings 31 being attached to the base of the block which contains an impervius membrane 38, a piezoelectric crystal 39, a metal rod 40, a metal tube 31, an insulated plug 43 and a screw 44. In addition a separate cable to each of these assemblies enables the combined signal to be applied to each of the piezoelectric crystals 39.

Energisation of the piezoelectric crystal 39 by the combined signal produce pressure variations in the liquid contained in the recess 31 and in the jet of liquid issuing from the nozzle 32 thus causing regular variations in the cross section of the jet so that the jet subsequently breaks down into a stream of drops.

Although all the nozzles in a row can be attached to a common housing, it is preferred that each nozzle in a row has its own individual housing, all the housings in the row being connected via the tubes 34 to a common source of liquid under pressure. It is further preferred that each individual housing has its own piezoelectric crystal which is individually energised as this enables the pressure amplitude, phasing and break up length of the jet produced by each nozzle to be separately regulated so ensuring that the resulting drop streams produced by all the guns in the row are in phase or substantially so. Such regulation can be achieved by adjusting the voltage (for example by means of a potentiometer) of the high frequency alternating signals applied to each piezo-crystal in the row of devices. Such regulation overcomes any differences in the drop streams which arise from minor variations in the components making up each device in the row.

If desired the chamber or chambers to which the nozzles are fitted and which contain the liquid before it passes through the nozzles can be partly filled with a filler which is accoustically matched to the liquid (i.e. the values of the density X velocity of sound for the two media are substantially equal). As examples of fillers there may be mentioned natural or synthetic rubbers such as a silicon rubber. In the event that the said filler is in contact with the impervious membrane then the two together in fact act as a combined membrane, or in the event that the filler is in direct contact with the piezoelectric crystal then the filler in fact acts as a membrane.

The impervious membranes can be formed of any suitable material, for example a thin sheet of metal or a rubber or plastic material.

As previously stated energisation of the piezoelectric crystal or vibrator imparts vibrations to the liquid so that the jet of liquid issuing from the nozzle breaks up into a stream of drops, and by the process of the invention the simultaneous application of the second high frequency alternating signal results in the stream of drops being free, or substantially free, from satellite drops.

We claim:

1. A process for the production of drop streams by modulating a liquid jet issuing from a nozzle wherein a liquid under pressure is supplied to a chamber which is fitted with a nozzle from which the liquid issues in the form of a jet, and a piezoelectric crystal which surrounds the nozzle or forms a part of a wall of the chamber has applied to it simultaneously a high frequency alternating signal of the fundamental frequency which causes drop formation and a second high frequency alternating signal the frequency of which is twice that of the fundamental signal.

2. A process for the production of drop streams by modulating a liquid jet issuing from a nozzle wherein a liquid under pressure is supplied to a chamber which is fitted with a nozzle from which the liquid issues in the form of a jet, and a piezoelectric crystal which forms part of a resonant component is in contact with the liquid in the chamber or is in contact with an impervious membrane which is itself in contact with the liquid, and to the piezoelectric crystal there is simultaneously applied a high frequency alternating signal of the fundamental frequency which causes drop formation and a second high frequency alternating signal the frequency of which is twice that of the fundamental signal.

* * * * *